US009659683B2

(12) United States Patent
Huang et al.

(10) Patent No.: US 9,659,683 B2
(45) Date of Patent: May 23, 2017

(54) COAXIAL CABLE AND MEDICAL CABLE USING THE SAME

(71) Applicant: Hitachi Metals, Ltd., Tokyo (JP)

(72) Inventors: Detian Huang, Hitachi (JP); Takanobu Watanabe, Hitachi (JP); Kimika Kudo, Kitaibaraki (JP); Haruyuki Watanabe, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/847,817

(22) Filed: Sep. 8, 2015

(65) Prior Publication Data

US 2016/0155535 A1 Jun. 2, 2016

(30) Foreign Application Priority Data

Nov. 27, 2014 (JP) ..... 2014-240065

(51) Int. Cl.

| | |
|---|---|
| ***H01B 7/00*** | (2006.01) |
| ***H01B 3/44*** | (2006.01) |
| ***H01B 1/02*** | (2006.01) |
| ***H01B 11/18*** | (2006.01) |

(52) U.S. Cl.

CPC ..... *H01B 3/442* (2013.01); *H01B 1/026* (2013.01); *H01B 3/441* (2013.01); *H01B 3/445* (2013.01); *H01B 11/1839* (2013.01)

(58) Field of Classification Search

USPC .... 174/102 R, 103, 108, 109, 110 R, 110 A, 174/112

See application file for complete search history.

(56) References Cited

U.S. PATENT DOCUMENTS

| | | | | | |
|---|---|---|---|---|---|
| 2,599,857 | A * | 6/1952 | Mildner | H01B 11/1834 | 174/29 |
| 3,748,373 | A * | 7/1973 | Remy | H01B 7/10 | 174/115 |
| 4,018,977 | A * | 4/1977 | Herrmann, Jr. | H01B 7/0233 | 174/24 |
| 5,262,593 | A * | 11/1993 | Madry | H01B 11/1856 | 174/102 P |
| 6,337,443 | B1 * | 1/2002 | Dlugas | H01B 11/1839 | 174/120 R |
| 6,472,603 | B1 * | 10/2002 | Inoue | H01B 11/1008 | 174/121 R |
| 2005/0115738 | A1 * | 6/2005 | Yamaguchi | H01B 11/1813 | 174/102 R |

FOREIGN PATENT DOCUMENTS

| | | |
|---|---|---|
| JP | 05-054729 | 3/1993 |
| JP | 2002367444 | 12/2002 |
| JP | 2011-228064 | 11/2011 |
| JP | 2012-104371 | 5/2012 |

* cited by examiner

*Primary Examiner* — William H Mayo, III
(74) *Attorney, Agent, or Firm* — Roberts Mlotkowski Safran Cole & Calderon P.C.

(57) ABSTRACT

A coaxial cable includes a center conductor, and an insulation formed surrounding the center conductor. The insulation includes an insulating tape that includes a mesh layer including a plurality of threads woven and a reinforcement layer attached to the mesh layer. The insulating tape is wound, with an overlap, around the center conductor such that the mesh layer is arranged as an outer peripheral surface.

7 Claims, 3 Drawing Sheets

COAXIAL CABLE AND MEDICAL CABLE USING THE SAME

The present application is based on Japanese patent application No. 2014-240065 filed on Nov. 27, 2014, the entire contents of which are incorporated herein by reference.

BACKGROUND OF THE INVENTION

1. Field of the Invention

The invention relates to a coaxial cable suitable for medical application such as ultrasound diagnosis and a medical cable using the coaxial cable.

2. Description of the Related Art

Signal lines of medical cables which are used for medical application such as ultrasound diagnosis are provided with a coaxial structure that prevents a leakage of internal signal or an external noise so as to efficiently transmit high-frequency signals (see e.g., JP-A-2002-367444).

To reduce the capacitance, the coaxial structure uses, as an insulation used therein, a foam insulation which contains a large number of air voids and has a lower permittivity as a whole than non-foam insulation not containing air voids (see e.g., JP-A-2011-228064).

SUMMARY OF THE INVENTION

The foam insulation is produced such that an insulating resin is foamed by a pressure foaming method such as physical foaming or chemical foaming (see e.g., JP-A-2012-104371). However, if a center conductor having a small diameter is used for the purpose of reducing the diameter of a medical cable, the center conductor may be damaged or broken under foaming pressure during air bubble generation.

In forming a thin foam insulation of an insulating resin so as to reduce the diameter of the medical cable, it is difficult to uniformly disperse the air voids in the insulating resin by the pressure foaming method such as physical foaming or chemical foaming. Thus it is not possible to attain desired electrical characteristics.

As a method of forming the foam insulation surrounding the center conductor, a method is known in which a foam insulation tape is wound around the center conductor to form the foam insulation (see e.g., JP-A-H05-54729). However, since the foam insulation tape contains a large amount of air voids, a breakage may occur from the air voids due to the winding tension applied when the tape is wound around the center conductor.

Especially in winding a foam insulation tape around a center conductor of 48 or less in AWG (American Wire Gauge), the tape needs to be very thin and very narrow. Since the thin and narrow foam insulation tape may be broken by winding tension as described above, it is impossible to form the foam insulation by winding the foam insulation tape around the center conductor.

It is an object of the invention to provide a coaxial cable that a damage or breakage of a center conductor is prevented so as to attain desired electrical characteristics even if the center conductor has a very small outer diameter, as well as a medical cable using the coaxial cable.

(1) According to one embodiment of the invention, a coaxial cable comprises:

a center conductor; and an insulation formed surrounding the center conductor, wherein the insulation comprises an insulating tape that comprises a mesh layer comprising a plurality of threads woven and a reinforcement layer attached (or heat-sealed) to the mesh layer, and, wherein the insulating tape is wound, with an overlap, around the center conductor such that the mesh layer is arranged as an outer peripheral surface.

In the above embodiment (1) of the invention, the following modifications and changes can be made.

(i) The threads comprise a polytetrafluoroethylene or polyethylene, and wherein the reinforcement layer comprises a polyethylene terephthalate.

(ii) The coaxial cable further comprises a protector formed surrounding the insulation.

(iii) The protector comprises a protective tape wound around the insulation or a protective layer molded around the insulation by non-filled extrusion.

(iv) The insulating tape is not more than 30 μm in thickness.

(2) According to another embodiment of the invention, a medical cable comprises a plurality of core wire units, wherein the plurality of core wire units each comprise a plurality of ones of coaxial cable according to the embodiment (1) that are twisted together.

Effects of the Invention

According to an embodiment of the invention, a coaxial cable can be provided that a damage or breakage of a center conductor is prevented so as to attain desired electrical characteristics even if the center conductor has a very small outer diameter, as well as a medical cable using the coaxial cable.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described below in conjunction with the appended drawings.

Figure 1:
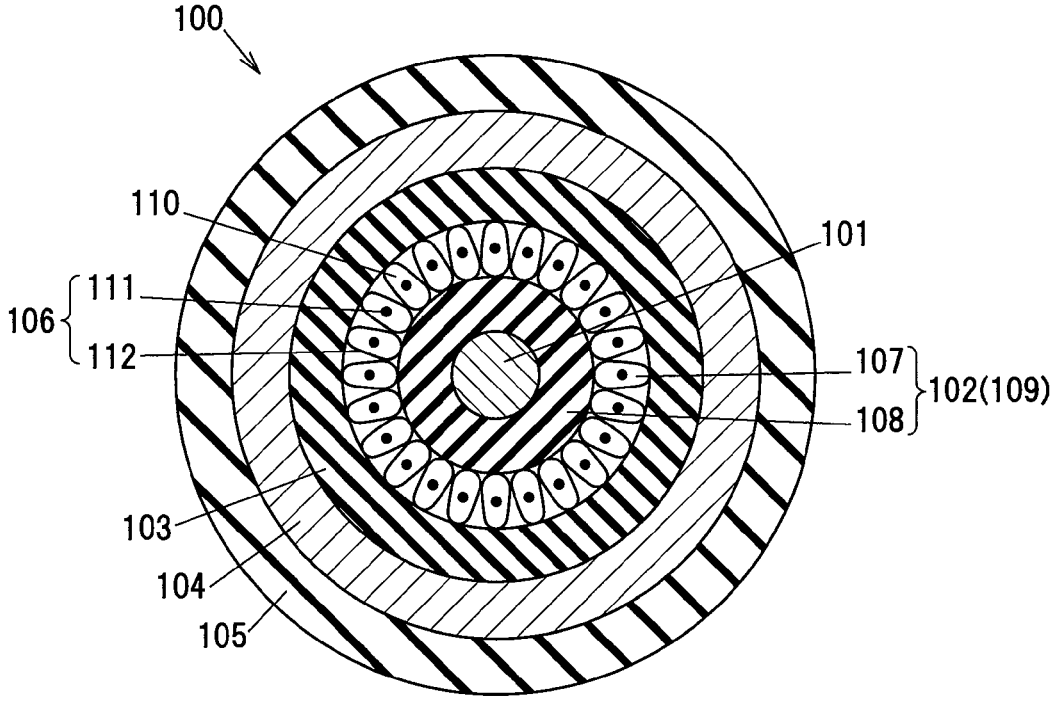
FIG. 1 is a cross sectional view schematically showing a coaxial cable in an embodiment of the present invention.

As shown in FIG. 1, a coaxial cable 100 in a preferred embodiment of the invention is provided with a center conductor 101, an insulation 102 formed to surround the center conductor 101, a protector 103 formed to surround the insulation 102, a shield 104 formed to surround the protector 103, and a jacket 105 formed to surround the shield 104.

The center conductor 101, which constitutes the inner conductor in the coaxial structure, is formed of, e.g., a solid wire or twisted wire which is made of a highly conductive material such as copper or copper alloy and has a silver- or tin-plated surface.

The insulation 102 and the protector 103 constitute the insulation in the coaxial structure. Of those, the insulation 102 is formed of an insulating tape 109 which is composed of a mesh layer 107 having a thickness of about not more than 25 μm and formed by weaving plural threads 106 and a reinforcement layer 108 having a thickness of about not more than 5 μm and heat-sealed to the mesh layer 107. The insulating tape 109 has a total thickness of not more than 30

μm and is spirally wound, with an overlap, around the center conductor 101 so that the mesh layer 107 is arranged as the outer peripheral surface.

The protector 103 suppresses a decrease in a void fraction of the insulation 102 by preventing entry of the shield 104 into gaps 110 when the coaxial cable 100 is bent, penetration of a foreign substance into the into gaps 110 or damage on the mesh layer 107, and is formed of a protective tape wound around the insulation 102 or a protective layer molded around the insulation 102 by non-filled extrusion (tubular extrusion). The thickness of the protector 103 is preferably not less than 2.5 μm and not more than 6 μm.

Providing the protector 103 is desirable also for providing voltage resistance to the insulation 102.

The shield 104, which constitutes an outer conductor in the coaxial structure, is formed of a braided shield or served shield which is made of a highly conductive material such as copper or copper alloy and has a silver- or tin-plated surface.

The jacket 105 is formed by, e.g., winding, with an overlap, a resin tape having a thickness of not less than 2 μm and not more than 6 μm and made of a resin having excellent mechanical strength such as polyethylene terephthalate (PET), or is formed of a resin having high mechanical characteristics or high chemical resistance such as fluorine resin so as to have a thickness of not more than 30 μm, and is provided to prevent deterioration in electrical characteristics caused by damage on the shield 104.

The thread 106 is formed of a low-permittivity material such as polytetrafluoroethylene or polyethylene. The reinforcement layer 108 is formed of a material with high mechanical strength such as polyethylene terephthalate, polyimide (PI), polyetherimide (PEI) and polyether ether ketone (PEEK) which have a tensile strength of not less than 100 MPa.

Of those listed as a material of the reinforcement layer 108, a highly oriented polyethylene terephthalate having a tensile strength of about 400 MPa is especially preferable.

Such a reinforcement layer 108, even having a thickness of about not more than 5 μm, can prevent stretch or breakage of the mesh layer 107 due to winding tension at the time of winding the insulating tape 109 around the center conductor 101, thereby contributing to reduction in diameter of the coaxial cable 100.

Figure 2:
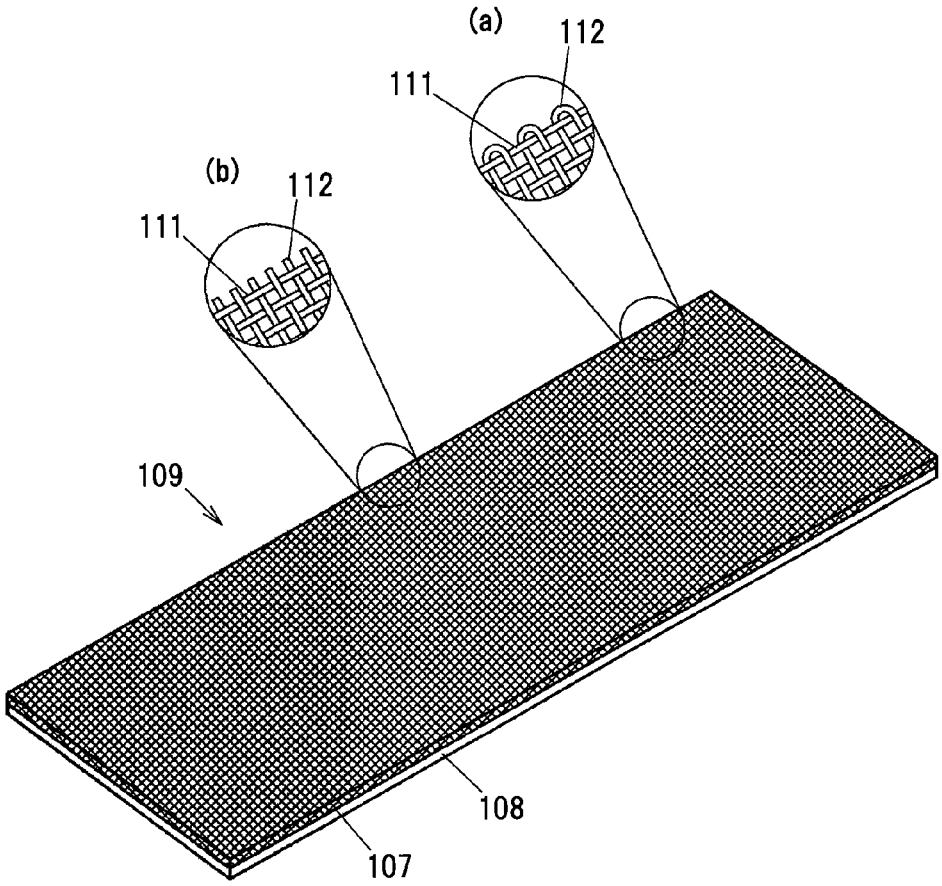
FIG. 2 is a perspective view schematically showing an insulating tape.

As shown in FIG. 2, the mesh layer 107 is formed by, e.g., weaving a weft thread 112 through plural parallel warp threads 111 along the alignment direction thereof from one edge to another in a zigzag manner (see the enlarged view (a)), or by interweaving plural parallel weft threads 112 in plural parallel warp threads 111 (see the enlarged view (b)), and the gaps 110 supported by the threads 106 are uniformly present inside the mesh layer 107.

This allows the insulation 102 to have a uniform void fraction throughout the longitudinal direction of the coaxial cable 100. As a result, the insulation 102 has a uniform permittivity throughout the longitudinal direction of the coaxial cable 100 and it is thereby possible to achieve the coaxial cable 100 having desired electrical characteristics.

In addition, coarseness of the mesh layer 107, i.e., the void fraction of the insulation 102 can be appropriately changed according to the required permittivity.

In place of the mesh layer 107 formed by weaving the plural threads 106, a nonwoven layer formed by entangling the plural threads 106 may be alternatively used.

For forming the insulating tape 109, a mesh sheet formed by weaving the plural threads 106 formed of a low-permittivity material such as polytetrafluoroethylene or polyethylene is heat-sealed and attached to a reinforcement sheet formed of a material with high mechanical strength such as polyethylene terephthalate to integrate into an insulating sheet which is then cut to desired width and length.

Thus, the mesh layer 107 in a form easily stretched is reinforced by the reinforcement layer 108. This prevents collapse of the gaps 110 caused by stretch of the mesh layer 107 due to winding tension at the time of winding the insulating tape 109 around the center conductor 101 and also prevents breakage of the mesh layer 107.

As such, the coaxial cable 100 does not use a foamed resin as the insulation 102 and thus can avoid damage or breakage of the center conductor 101 even when the center conductor 101 having a small diameter is used to reduce the diameter of the coaxial cable 100.

In addition, in the coaxial cable 100 of the present embodiment, the gaps 110 are uniformly present inside the mesh layer 107 and it is thus possible to achieve desired electrical characteristics even when a thin insulating tape 109 is used to form a thin insulation 102 to reduce the diameter of the coaxial cable 100.

Furthermore, in the coaxial cable 100 of the present embodiment, the mesh layer 107 is reinforced by the reinforcement layer 108 and the insulating tape 109 is thus less likely to be broken by winding tension at the time of winding the insulating tape 109 around the center conductor 101 even when a thin insulating tape 109 is used to form a thin insulation 102 to reduce the diameter of the coaxial cable 100.

Therefore, in the coaxial cable 100 of the present embodiment, even when the insulating tape 109 is wound around the center conductor 101 of 48 or less in AWG (American Wire Gauge), the insulating tape 109 is not broken and can be wound around the center conductor 101 to form the insulation 102.

Figure 3:
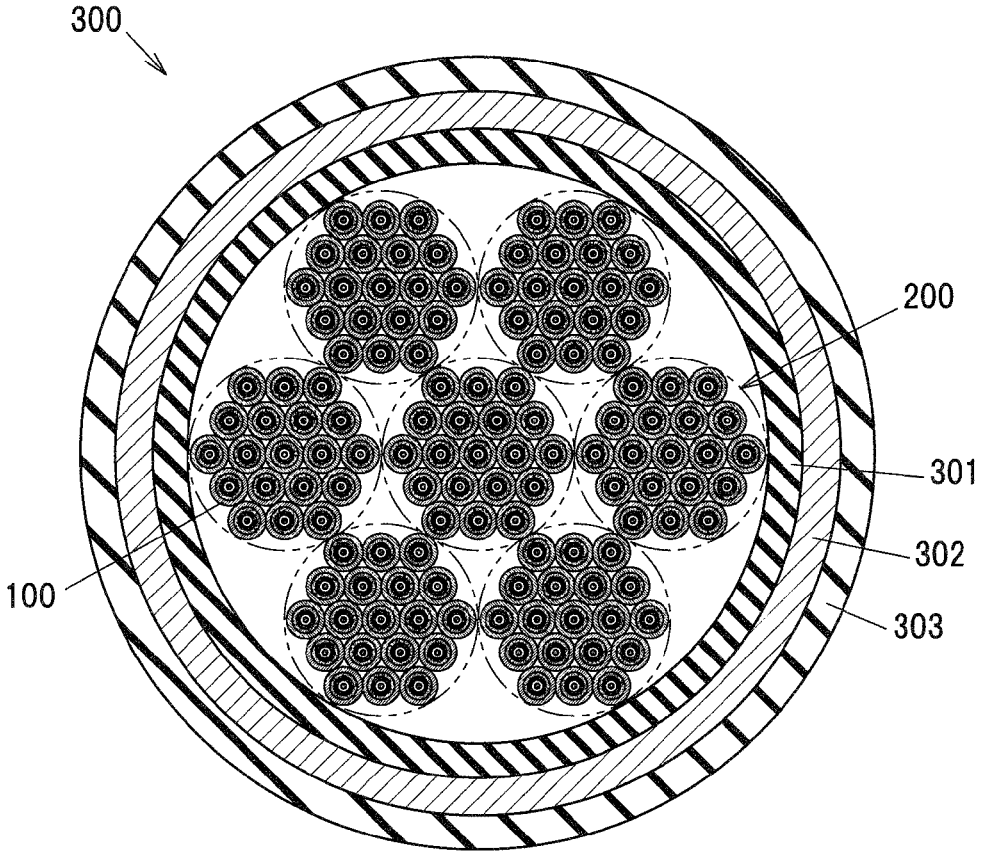
FIG. 3 is a cross sectional view schematically showing a medical cable in an embodiment of the invention.

As shown in FIG. 3, it is possible to provide a medical cable 300 such as a probe cable, in which plural core wire units 200 each formed by twisting plural coaxial cables 100 together are bundled by, e.g., a binding tape 301, a braided shield 302 and a sheath 303, etc. Also in this case, it is possible to contribute to reduction in diameter of the medical cable 300.

As described above, according to the invention, even when the center conductor 101 used has a small diameter, damage or breakage of the center conductor 101 is avoided and it is thus possible to provide the coaxial cable 100 which can achieve desired electrical characteristics.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A coaxial cable, comprising:

a center conductor; and an insulation formed surrounding the center conductor, wherein the insulation comprises an insulating tape that comprises a mesh layer comprising a plurality of threads woven and a reinforcement layer attached to the mesh layer, and, wherein the insulating tape is wound, with an overlap, around the center conductor such that the reinforcement layer contacts the center conductor and the mesh layer does not contact the center conductor and is arranged as an outer peripheral surface.

2. The coaxial cable according to claim 1, wherein the threads comprise a polytetrafluoroethylene or polyethylene, and wherein the reinforcement layer comprises a polyethylene terephthalate.

3. The coaxial cable according to claim 1, further comprising a protector formed surrounding the insulation.

4. The coaxial cable according to claim 3, wherein the protector comprises a protective tape wound around the insulation or a protective layer molded around the insulation by non-filled extrusion.

5. The coaxial cable according to claim 1, wherein the insulating tape is not more than 30 μm in thickness.

6. A medical cable, comprising a plurality of core wire units, wherein the plurality of core wire units each comprise a plurality of ones of coaxial cable according to claim 1 that are twisted together.

7. The coaxial cable according to claim 1, wherein neither the reinforcement layer or the mesh layer are formed from a foamed resin.

* * * * *